US006250983B1

(12) United States Patent
Paterson

(10) Patent No.: US 6,250,983 B1
(45) Date of Patent: Jun. 26, 2001

(54) PERSONAL WATERCRAFT

(76) Inventor: William Paterson, 1948 Peterson La., Santa Rosa, CA (US) 95403

( * ) Notice: Subject to any disclaimer, the term of this patent is extended or adjusted under 35 U.S.C. 154(b) by 0 days.

(21) Appl. No.: 09/427,052

(22) Filed: Oct. 26, 1999

(51) Int. Cl.[7] ..... B63B 35/78

(52) U.S. Cl. ..... 441/132; 114/344; 114/351; 114/357; 114/363

(58) Field of Search ..... 114/351, 344, 114/357, 363; 441/130, 132, 65

(56) References Cited

U.S. PATENT DOCUMENTS

| | | | | |
|---|---|---|---|---|
| D. 290,108 | | 6/1987 | Wolfe . | |
| D. 362,706 | | 9/1995 | Wamsley . | |
| 2,260,676 | * | 10/1941 | Lafaye, Sr. | 114/344 |
| 2,617,139 | * | 11/1952 | Bittel | 114/344 |
| 2,816,297 | * | 12/1957 | Stanley | 114/351 |
| 3,067,441 | * | 12/1962 | Dysard et al. | 441/132 |
| 3,133,294 | * | 5/1964 | Kunz | 114/357 |
| 5,217,400 | * | 6/1993 | Creek et al. | 441/132 |
| 5,597,277 | | 1/1997 | Mayfield . | |
| 5,885,123 | | 3/1999 | Clifford . | |
| 6,155,899 | * | 12/2000 | Boddy | 441/130 |

* cited by examiner

*Primary Examiner*—Sherman Basinger
(74) *Attorney, Agent, or Firm*—Jack Lo

(57) ABSTRACT

The present personal watercraft is comprised of a hull with a center portion, and a pair of elongated side pontoons extending substantially behind the center portion. A rear-facing seat is arranged on the rear of the center portion. The rear of the hull behind the seat and between the pontoons is open for enabling a rider to kick for propulsion. The center portion and the pontoons each have a curved bottom for improving directional control. The hull includes a bow with a substantially slanted bottom, and sides that converge to a point for improving speed and gliding over seaweed. The hull is preferably made of a floatable rigid material. A watertight storage compartment is provided in the center portion for stowing equipment. Seat belts are connected across the seat for securing a rider in rough water. A removable apron is stretched across the pontoons behind the seat for use in fly fishing. A detachable harness attached to the top of the pontoons allow the watercraft to be carried on the back of a person. A detachable undercarriage and tow bar allow the watercraft to be towed behind a vehicle. A camouflage mesh tent is removably attached on the hull for use in hunting.

20 Claims, 3 Drawing Sheets

PERSONAL WATERCRAFT

BACKGROUND OF THE INVENTION

1. Field of the Invention

This invention relates generally to very small watercrafts for use in water sports.

2. Prior Art

Small personal watercrafts are typically used to transport divers, sports fishermen, and hunters to their favorite waters. Power boats are traditionally the most common type of personal watercraft. However, due to environmental concerns, power boats are increasingly banned from lakes, rivers, and beaches. As a result, human powered watercrafts are becoming more popular. Canoes and kayaks comprise the majority of such watercrafts, but their size and weight prevent them from being used in difficult-to-reach areas, because they cannot be easily carried far from automobiles. Although inflatable floatation devices are lightweight and easy to carry, their blunt shapes severely limit their speed on the water, and they are also susceptible to puncture by fish hooks and sharp rocks.

The personal watercrafts shown in U.S. Pat. No. 5,885,123 to Clifford and D290,108 to Wolfe are each comprised of a U-shaped tube with a flexible rear-facing seat connected between its arms. The back of the craft is open for easy entry and exit. The craft is propelled by kicking the legs, preferably with swim fins on. Due to the small diameter of the tube, the draft of the craft is relatively deep, that is, the crafts sits deeply in the water. The flexible seat is formed into a blunt shape projecting well below the tube when a person is seated in it. The deep draft, combined with the blunt seat and blunt front end of the tube, makes the craft very slow and difficult to use on shallow water. A rider will particularly have difficulty going over seaweed. Further, the deep seating position and the soft seat make the rider vulnerable to injury when striking hard underwater objects.

U.S. Pat. No. D362,706 to Wamsley shows a U-shaped fishing float with a seat attached to a rigid platform between its arms. The back of the craft is open for easy entry and exit. However, the speed of the craft and its ability to go over seaweed are even more severely limited by the completely straight, flat, and vertical bow. Also, the completely flat bottom reduces stability and directional control.

U.S. Pat. No. 5,597,277 to Mayfield shows a personal watercraft having a hull with a pointed bow and a closed stern. A full keel projects well below the hull, and a rear-facing seat is arranged within the keel. The legs of the rider project into the water through a hole in the keel. However, the closed stern hinders the legs when they are kicking for propulsion, and also makes entry and exit very difficult. The deeply projecting keel slows the craft, and makes going over seaweed very difficult. The deep draft also makes operation on shallow water difficult.

Although prior art personal watercrafts are small and lightweight, their odd shapes make them awkward to carry by hand. In rough waters, the riders may be thrown off these crafts. They cannot stow equipment or supplies. They also cannot be easily concealed when used in hunting. Some prior art watercrafts require inflation or assembly before use.

OBJECTS OF THE INVENTION

Accordingly, objects of the present personal watercraft are:

to provide floatation on water for a rider;

to be usable without inflation or assembly;

to be very easy to carry by a person;

to be immune to puncture;

to be easy to enter and exit;

to allow a rider to freely kick his or her legs for propulsion;

to protect the rider from injury from striking hard underwater objects;

to be fast and maneuverable;

to have good directional control;

to glide over seaweed easily;

to have a shallow draft for use in shallow water;

to secure a rider in rough waters;

to enable towing by a vehicle; and to have room for stowing equipment.

Further objects of the present invention will become apparent from a consideration of the drawings and ensuing description.

BRIEF SUMMARY OF THE INVENTION

The present personal watercraft is comprised of a hull with a center portion, and a pair of elongated side pontoons extending substantially behind the center portion. A rear-facing seat is arranged on the rear of the center portion. The rear of the hull behind the seat and between the pontoons is open for enabling a rider to kick for propulsion. The center portion and the pontoons each have a curved bottom for improving directional control. The hull includes a bow with a substantially slanted bottom, and sides that converge to a point for improving speed and gliding over seaweed. The hull is preferably made of a floatable rigid material. A watertight storage compartment is provided in the center portion for stowing equipment. Seat belts are connected across the seat for securing a rider in rough water. A removable apron is stretched across the pontoons behind the seat for use in fly fishing. A detachable harness attached to the top of the pontoons allow the watercraft to be carried on the back of a person. A detachable undercarriage and tow bar allow the watercraft to be towed behind a vehicle. A camouflage mesh tent is removably attached on the hull for use in hunting.

DRAWING REFERENCE NUMERALS

10. Hull
11. Center Portion
12. Seat
13. Pontoons
14. Stern
15. Bow
16. Storage Compartment

17. Seatbelt
18. Apron
19. Detachable Fasteners
20. Harness
21. Transverse Back
22. Longitudinal Shoulder Straps
23. Transverse Chest Strap
24. Undercarriage
25. Tow Bar
26. Strap
27. Strap
28. Strap
29. Attachment Points
30. Arms
31. Rod Holders
32. Straps
33. Mesh Tent
34. Detachable Fasteners
35. Open Back
36. Seat Back

DETAILED DESCRIPTION OF THE INVENTION

Figure 1:
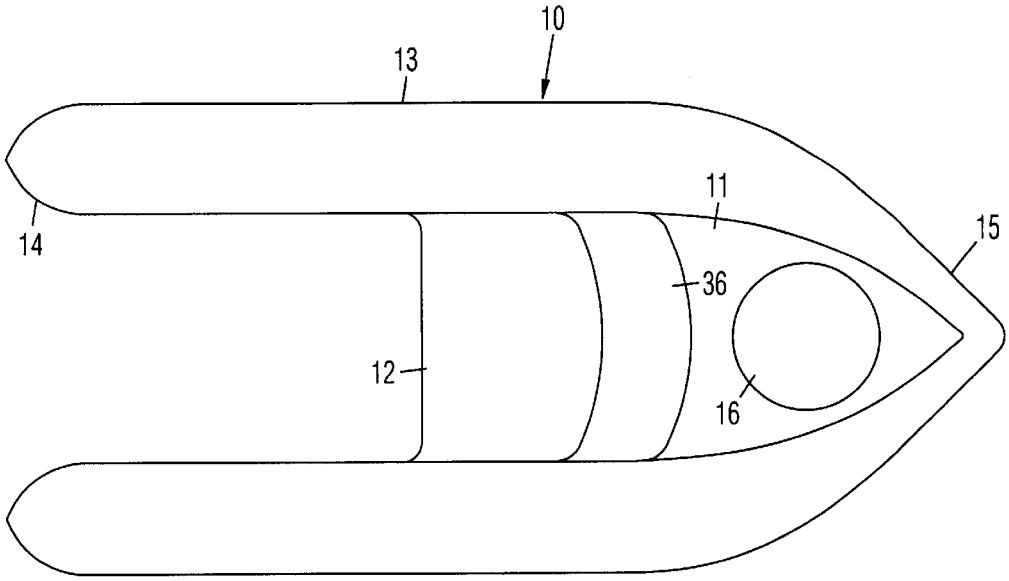
FIG. 1 is a top view of the present personal watercraft.
Figure 2:
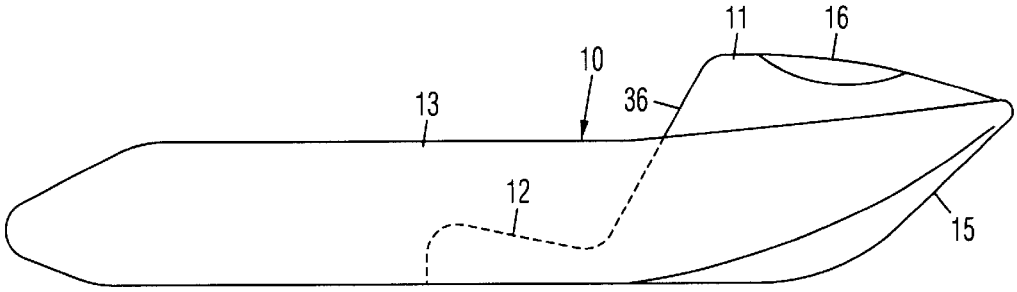
FIG. 2 is a side view thereof.
Figure 3:
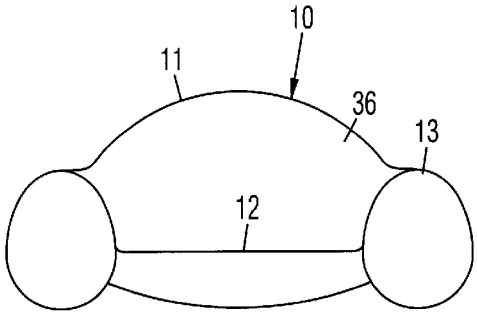
FIG. 3 is a rear end view thereof.

FIGS. 1–3:

A preferred embodiment of the present personal watercraft is shown in a top view in FIG. 1, a side view in FIG. 2, and a rear end view in FIG. 3. It is comprised of a hull 10 with a center portion 11 which has a rear surface that forms a seat back 36. A seat 12 is attached to a lower end of seat back 36. A pair of elongated side pontoons 13 are attached to opposite sides of center portion 11, and extend substantially behind center portion 11. Center portion 11 projects substantially above side pontoons 13, so that seat back 36 is substantially taller than side pontoons 13. A top surface of seat 12 is substantially below the top surfaces of side pontoons 13. A bottom surface of seat 12 is generally coplanar with a bottom of center portion 11. A stern 14 of hull 10 behind seat 12 and between pontoons 13 is open for enabling a rider to freely kick for propulsion. Center portion 11 and pontoons 13 each have a bottom bowed outwardly about a longitudinal axis for improving directional control. To improve speed, the bottoms of center portion 11 and pontoons 13 are generally on a similar plane, i.e., nothing projects deeply into the water. Seat 12 is rigid for protecting the rider from injury when striking hard underwater objects. Hull 10 is wide and long enough for a shallow draft, so that the watercraft can be used in shallow waters.

Hull 10 includes a bow 15 with a substantially slanted bottom, and sides that converge to a point for further improving speed and gliding over seaweed. The rear ends of pontoons 13 are tapered for low drag. A watertight storage compartment 16 is provided in center portion 11 for stowing equipment. Hull 10 is preferably made as a single integrated structure with a floatable rigid material, such as polyethylene, fiberglass, rigid polyurethane foam, or rigid polystyrene foam.

Figure 4:
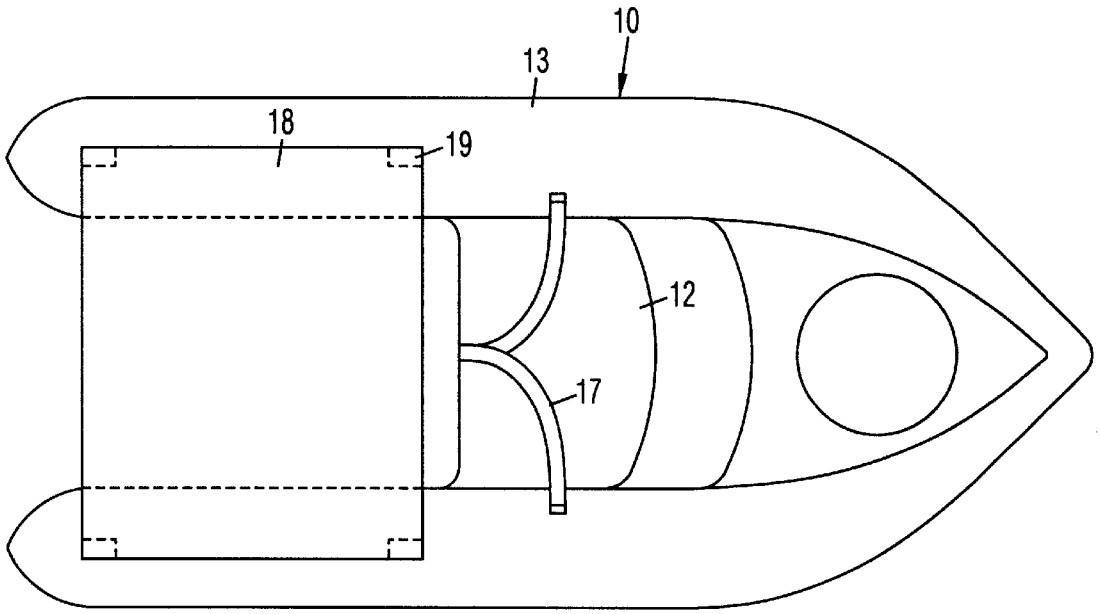
FIG. 4 is a top view thereof with a fly fishing apron and seat belts attached.

FIG. 4:

In FIG. 4, seat belts 17 are connected across seat 12 for securing a rider in rough waters. A flexible apron 18 is positioned behind seat 12 and attached between pontoons 13 with detachable fasteners 19 for supporting a loose fishing line when fly fishing.

Figure 5:
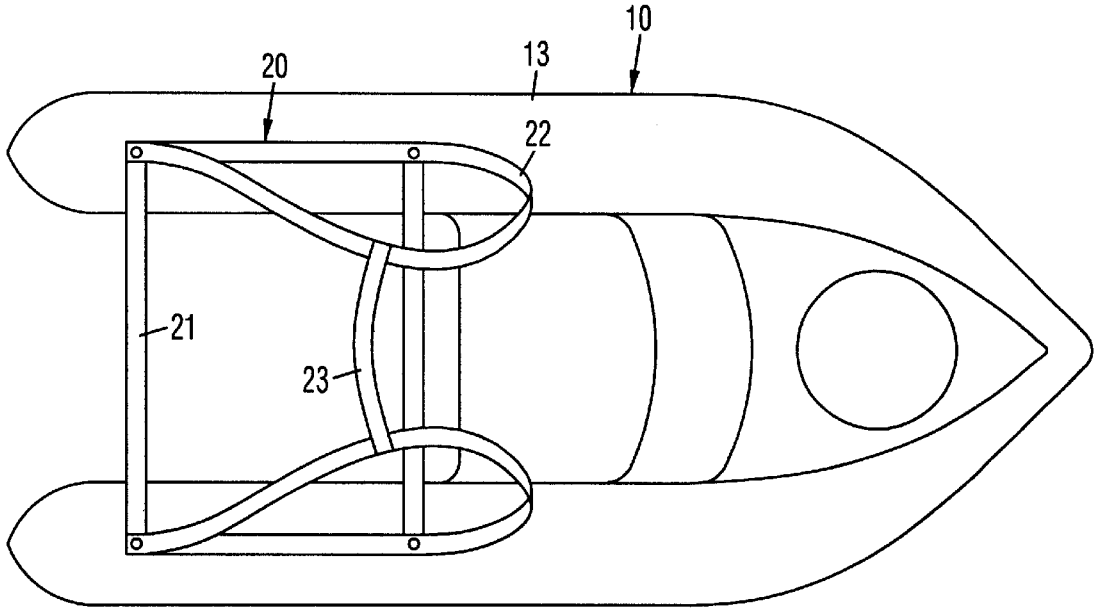
FIG. 5 is a top view thereof with a carrying harness attached.

FIG. 5:

In FIG. 5, a detachable carrying harness 20 is attached to the tops of pontoons 13 for allowing the watercraft to be carried on the back of a person and transported between a parked vehicle and the launch point. Harness 20 is comprised of a pair of transverse back straps 21 attached between pontoons 13, a pair of longitudinal shoulder straps 22 attached to transverse straps 21, and a transverse chest strap 23 attached across the front of shoulder straps 22.

Figure 6:
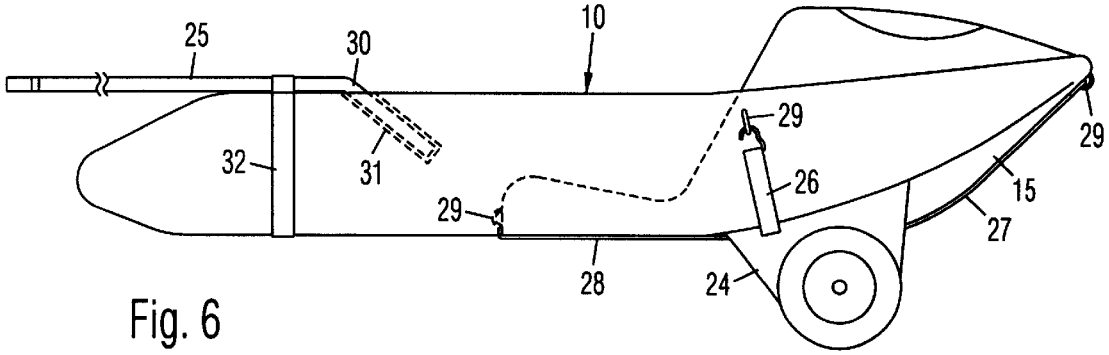
FIG. 6 is a side thereof with a detachable undercarriage and tow bar attached.

FIG. 6:

In FIG. 6, a detachable undercarriage 24 and a detachable tow bar 25 are attached to the watercraft for allowing it to be towed behind a vehicle, such as a bicycle. Undercarriage 24 is secured under hull 10 near bow 15 by straps 26-28 extending from undercarriage 24 and hooked to attachment points 29 on the sides and bottom of hull 10. Tow bar 25 includes a pair of arms 30 (one shown) inserted into rod holders 31 in pontoons 13, and secured thereon by straps 32. Rod holders 31 may also be used to hold fishing rods. When used as a tow bar, the rear ends of arms 30 are connected together for attaching to the towing vehicle. The rear ends of arms 30 may be separate and used as handles for pushing the watercraft like a wheeled cart by hand.

Figure 7:
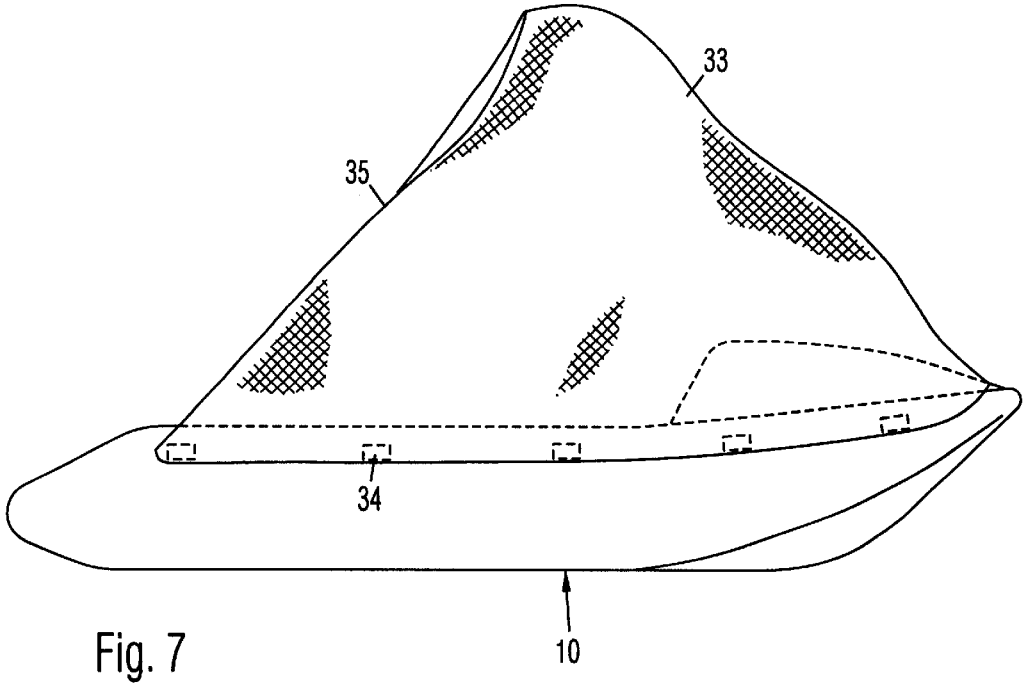
FIG. 7 is a side view thereof with a camouflage mesh tent attached.

FIG. 7:

In FIG. 7, a camouflage mesh tent 33 is removably attached around hull 10 by detachable fasteners 34 for use in hunting. Tent 33 includes an open back 35.

SUMMARY AND SCOPE

Accordingly, the present personal watercraft provides floatation for a rider engaged in water sports, such as diving, sports fishing, hunting, etc. It is made as a single integrated structure which is usable without inflation or assembly. It is small and lightweight, so that it is easy to carry by a person. It is made of a rigid material which is immune to puncture. It has a completely open stern, so that it is easy to enter and exit. The open stern allows a rider to freely kick his or her legs for propulsion. It protects the rider from injury when striking hard underwater objects. Its pointed bow makes it fast and maneuverable, and allows it to glide over seaweed easily. Its curved bottom provides good directional control. It has a shallow draft for use in shallow waters. It secures the rider in rough waters. It can be towed by a vehicle. It also provides room for stowing equipment.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

What is claimed is:

1. A personal watercraft, comprising:

a hull with a bow at a front end and a stern at a rear end, wherein said hull is comprised of: a center portion;

a pair of elongated side pontoons attached to opposite sides of said center portion, wherein said pontoons extend substantially behind said center portion, and said center portion projects substantially above said pontoons;

a rear surface on said center portion defining an integral seat back; and a seat attached to a bottom end of said seat back, wherein a top surface of said seat is substantially below top surfaces of said pontoons, and a bottom surface of said seat is generally coplanar with a bottom of said center portion, said seat is rigid for protecting a rider from injury when striking hard underwater objects; wherein said stern of said hull behind said seat and between said pontoons is open for enabling said rider to freely kick for propulsion; and said bow including a substantially slanted bottom, and sides converging generally to a point for improving speed and gliding over seaweed.

2. The personal watercraft of claim 1, wherein said hull is made as a single integrated structure with a floatable rigid material for low cost and immunity against puncture.

3. The personal watercraft of claim 1, further including a watertight storage compartment provided in said center portion for stowing equipment.

4. The personal watercraft of claim 1, further including a seat belt connected across said seat for securing said rider in rough waters.

5. The personal watercraft of claim 1, further including an apron positioned behind said seat and attached between said pontoons with detachable fasteners for supporting equipment.

6. The personal watercraft of claim 1, further including a detachable carrying harness attached to said hull for allowing said watercraft to be carried on a back of a person and transported between a parked vehicle and a launch point.

7. The personal watercraft of claim 1, further including a detachable carrying harness attached to said hull for allowing said watercraft to be carried on a back of a person and transported between a parked vehicle and a launch point, said harness comprising a pair of transverse back straps attached to said pontoons, a pair of longitudinal shoulder straps attached to said transverse straps, and a transverse chest strap attached across said shoulder straps.

8. The personal watercraft of claim 1, further including a detachable undercarriage and a detachable tow bar attached to said hull for towing behind a vehicle.

9. The personal watercraft of claim 1, further including a detachable undercarriage and a pair of detachable handle bars attached to said hull for being pushed by hand.

10. The personal watercraft of claim 1, further including a camouflage mesh tent removably attached around said hull by detachable fasteners for use in hunting.

11. A personal watercraft, comprising:

a hull with a bow at a front end and a stern at a rear end, wherein said hull is comprised of:

a center portion;

a pair of elongated side pontoons attached to opposite sides of said center portion, wherein said pontoons extend substantially behind said center portion, said pontoons have tapered rear ends that terminate in generally rounded tips for low drag, and said center portion projects substantially above said pontoons;

a rear surface on said center portion defining an integral seat back; and a seat attached to a bottom end of said seat back, wherein a top surface of said seat is substantially below top surfaces of said pontoons, and a bottom surface of said seat is generally coplanar with a bottom of said center portion, said seat is rigid for protecting a rider from injury when striking hard underwater objects; wherein said stem of said hull behind said seat and between said pontoons is open for enabling said rider to freely kick for propulsion;

said bow including a substantially slanted bottom, and sides converging generally to a point for improving speed and gliding over seaweed.

12. The personal watercraft of claim 11, wherein said hull is made as a single integrated structure with a floatable rigid material for low cost and immunity against puncture.

13. The personal watercraft of claim 11, further including a watertight storage compartment provided in said center portion for stowing equipment.

14. The personal watercraft of claim 11, further including a seat belt connected across said seat for securing said rider in rough waters.

15. The personal watercraft of claim 11, further including an apron positioned behind said seat and attached between said pontoons with detachable fasteners for supporting equipment.

16. The personal watercraft of claim 11, further including a detachable carrying harness attached to said hull for allowing said watercraft to be carried on a back of a person and transported between a parked vehicle and a launch point.

17. The personal watercraft of claim 11, further including a detachable carrying harness attached to said hull for allowing said watercraft to be carried on a back of a person and transported between a parked vehicle and a launch point, said harness comprising a pair of transverse back straps attached to said pontoons, a pair of longitudinal shoulder straps attached to said transverse straps, and a transverse chest strap attached across said shoulder straps.

18. The personal watercraft of claim 11, further including a detachable undercarriage and a detachable tow bar attached to said hull for being towed behind a vehicle.

19. The personal watercraft of claim 11, further including a detachable undercarriage and a pair of detachable handle bars attached to said hull for being pushed by hand.

20. The personal watercraft of claim 11, further including a camouflage mesh tent removably attached around said hull by detachable fasteners for use in hunting.

* * * * *